US011441079B2

(12) United States Patent
Bowser, Jr. et al.

(10) Patent No.: US 11,441,079 B2
(45) Date of Patent: Sep. 13, 2022

(54) METHODS AND SYSTEMS FOR CONSTRUCTION AND/OR REPAIR OF COKE OVEN WALLS

(71) Applicant: FOSBEL, INC., Brook Park, OH (US)

(72) Inventors: Alan E. Bowser, Jr., Brook Park, OH (US); Mike Cofield, Brook Park, OH (US)

(73) Assignee: FOSBEL, INC., Brook Park, OH (US)

( * ) Notice: Subject to any disclaimer, the term of this patent is extended or adjusted under 35 U.S.C. 154(b) by 223 days.

(21) Appl. No.: 16/590,526

(22) Filed: Oct. 2, 2019

(65) Prior Publication Data

US 2021/0102124 A1 Apr. 8, 2021

(51) Int. Cl.
*C10B 29/02* (2006.01)

(52) U.S. Cl.
CPC ..... *C10B 29/02* (2013.01)

(58) Field of Classification Search
CPC ..... C10B 29/00; C10B 29/02; C10B 29/04; C10B 29/06; C10B 29/08; C10B 5/02
See application file for complete search history.

(56) References Cited

U.S. PATENT DOCUMENTS 1,486,401 A * 3/1924 Ackeren ..... C10B 29/02 202/223
2,141,035 A * 12/1938 Daniels ..... C10B 29/02 52/561
4,364,798 A * 12/1982 Costa ..... C10B 29/06 264/30
5,137,603 A 8/1992 Arthur, Jr. et al.
5,227,106 A 7/1993 Kolvek
5,228,995 A 7/1993 Westbrook, III
5,687,531 A 11/1997 Nelson et al.
(Continued)

FOREIGN PATENT DOCUMENTS

DE 581940 C * 8/1933 ..... C10B 29/02
WO WO 02/088276 11/2002

OTHER PUBLICATIONS

Espacenet translation of DE 581940.*
International Appln. No. PCT/US2020/053678, International Search Report and Written Opinion, dated Jan. 8, 2021.

*Primary Examiner* — Jonathan Luke Pilcher
(74) *Attorney, Agent, or Firm* — Nixon & Vanderhye P.C.

(57) ABSTRACT

Methods and systems for constructing a refractory wall structure having gas flue spaces are provided. In certain embodiments, a first course of the wall structure may be constructed by installing opposing refractory side wall panels that are separated by a distance which defines a widthwise dimension of the wall structure and an interior wall space therebetween. The side wall panels may include multiple sets of finger forms defining a joint space (e.g., a dovetail joint space), whereby the finger forms protrude inwardly into the interior wall space such that the sets of finger forms of one side panel are oppositely positioned relative to the sets of finger forms of an opposed side wall panel. Thereafter, a series of rigid refractory bridge components may be installed between respective oppositely positioned sets of the finger forms of the opposed wall panels so that a portion of the refractory bridge components is received with the joint space of the finger forms to thereby establish the flue spaces between longitudinally adjacent ones of the bridge components.

10 Claims, 15 Drawing Sheets

(56) References Cited

U.S. PATENT DOCUMENTS

| | | | | |
|---|---|---|---|---|
| 10,253,980 | B2 | 4/2019 | Boswer, Jr. | |
| 10,336,942 | B2 | 7/2019 | Bowser, Jr. | |
| 2017/0137714 | A1* | 5/2017 | West | C10B 5/06 |

* cited by examiner

METHODS AND SYSTEMS FOR CONSTRUCTION AND/OR REPAIR OF COKE OVEN WALLS

FIELD

The embodiments disclosed herein relate generally to coke oven wall structures and methods and systems by which such coke oven wall structures may be constructed and/or repaired.

BACKGROUND

Coke ovens traditionally comprise massive refractory brick structures in which there are batteries of adjacent parallel walls constructed from a large variety of differently shaped refractory bricks. The bricks must be able to withstand high temperatures and strong mechanical loading. At the same time, the interior regions of the walls contain flue ducts, burners, flue gas control passages and the like. The detailed design of the oven is usually quite complicated in order to obtain the necessary heat distribution within the oven and gas flows through the walls.

It follows from the above that coke ovens are relatively costly structures and any downtime for servicing and repairs can represent a significant economic loss for an operator.

Further, the production of ceramic bricks from which the walls are made is relatively costly and there is accordingly a need to generally reduce the number of different types of bricks which are used in a wall. It is undesirable, however, to have a design concept which utilizes relatively large ceramic bricks in the construction. Excessively large bricks cannot be handled without the use of specialized mechanical lifting devices. Further, bricks having a dimension greater than 650 mm machine pressed to form a fused silica product are generally unavailable. Bricks greater than this size can be hand cast but these are much more expensive. Large bricks can be machine pressed from conventional silica, but conventional silica bricks would have a very serious disadvantage in that a wall made therefrom would need a heat-up time which is many times greater than that for fused silica bricks.

While such prior proposals for coke oven corbel structures are satisfactory for their intended purpose, continual improvements are sought. It is towards providing such improvements that the embodiments disclosed herein are directed.

SUMMARY

In general, the embodiments disclosed herein are directed toward methods of constructing a refractory wall structure having gas flue spaces. A first course of the wall structure may be constructed in accordance with an embodiment by installing opposing refractory side wall panels that are separated by a distance which defines a widthwise dimension of the wall structure and an interior wall space therebetween. In certain embodiments the side wall panels may include multiple sets of finger forms defining a joint space (e.g., a dovetail joint space), the finger forms protruding inwardly into the interior wall space such that the sets of finger forms of one side panel are oppositely positioned relative to the sets of finger forms of an opposed side wall panel. Thereafter, a series of rigid refractory bridge components may be installed between respective oppositely positioned sets of the finger forms of the opposed wall panels so that a portion of the refractory bridge components is received with the joint space of the finger forms to thereby establish the flue spaces between longitudinally adjacent ones of the bridge components.

In some embodiments the bridge components are precast refractory bridge blocks that may be inserted into position between the side wall panels so that a portion of the bridge blocks is interlockingly joined to the side panels via the joint space. According to other embodiments, the bridge components are installed by positioning removable forms between longitudinally adjacent ones of the multiple sets of finger forms to thereby establish a bridge space between opposed surfaces of the removable forms which includes the joint spaced between the sets of finger forms and then pouring a castable refractory material into the bridge space. The castable refractory material is allowed to cure in the bridge space to thereby form the rigid refractory bridge components which extend the widthwise dimension of the wall structure.

Some embodiments will include pouring the castable refractory material into the bridge space such that a top surface of the castable refractory material in the bridge space forms a gap with the top edge surfaces of the side wall panels. A groove in the top surface of the castable refractory material (e.g., by forcibly pushing an appropriately sized and configured bar into the castable material prior to curing).

The removable forms can comprise H-shaped forms according to certain embodiments, e.g., forms that include a spaced apart pair of face panels and a cross-support extending between the face panels. The removable forms may also include L-shaped flanges at a bottom edge of the face panels (e.g., when constructing courses of the wall structure other than the first (ground) course).

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

Figure 1:
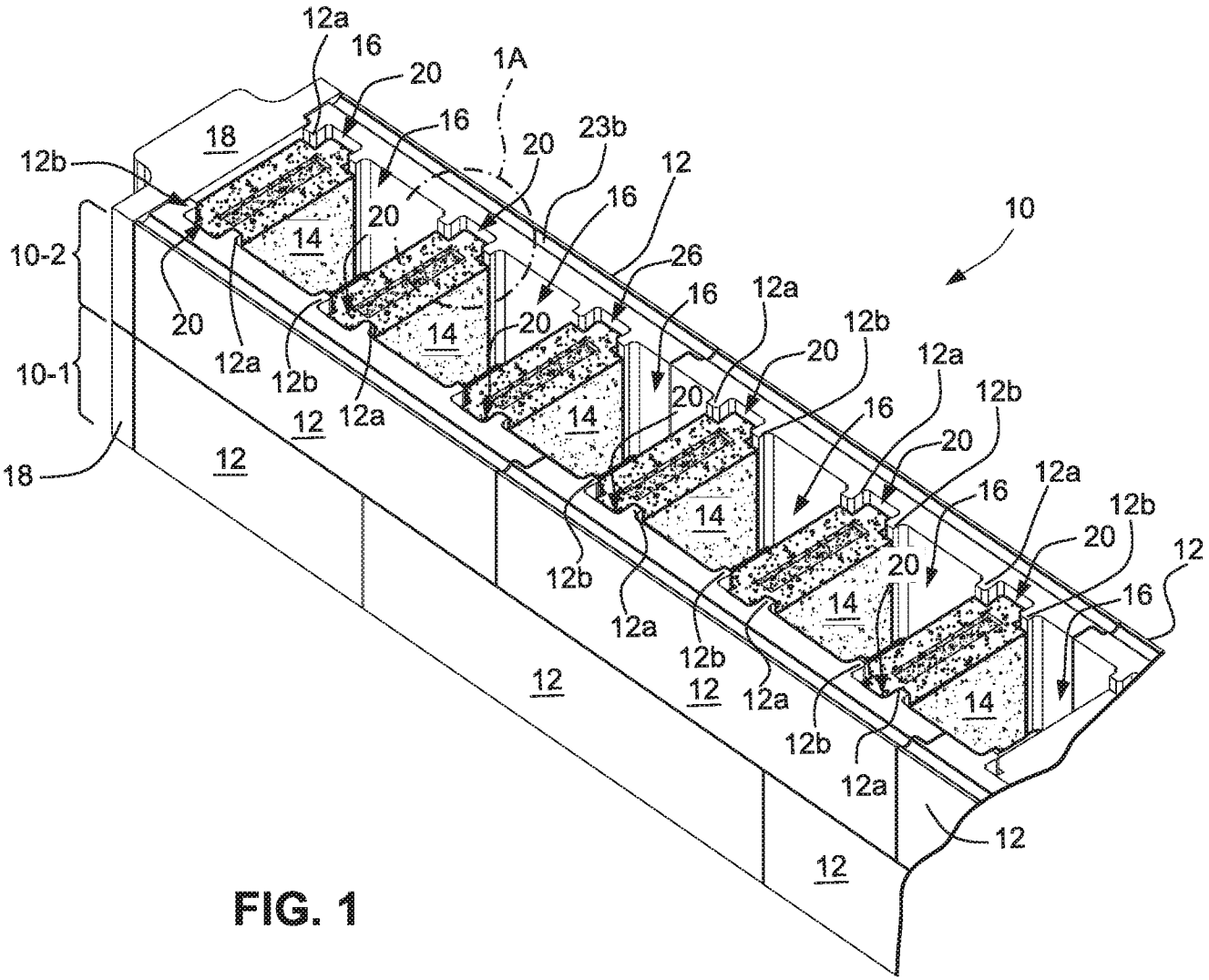
FIG. 1 is perspective view of a coke oven wall section in accordance with an embodiment of the present invention.
Figure 1A:
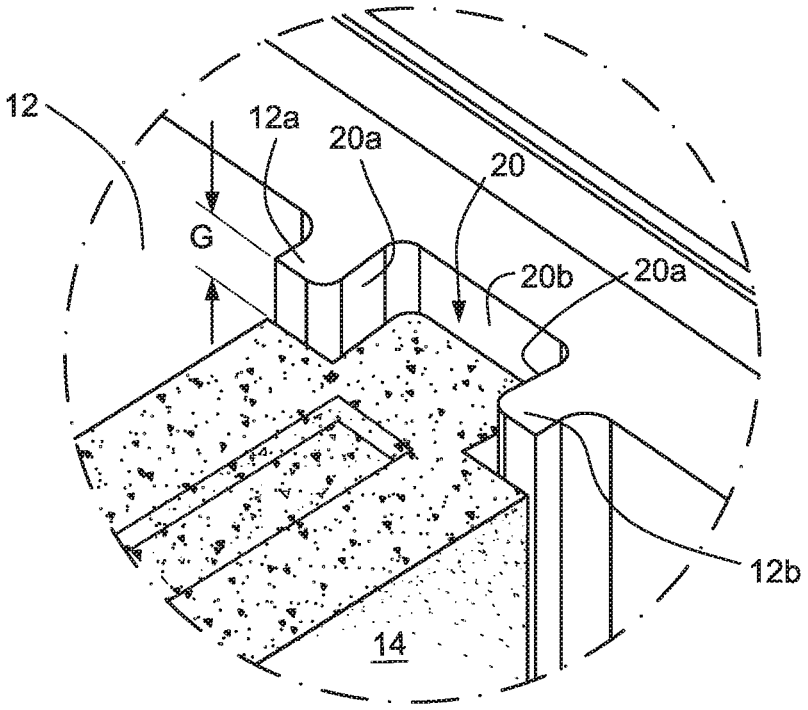
FIG. 1A is an enlarged detail view of dovetail interlock region between the terminal end of the cross-bridge component and a side wall panel.

Accompanying FIG. 1 shows an exemplary section of a coke oven wall 10 which embodies the present invention. As depicted in FIG. 1, the coke oven wall 10 is comprised of multiple vertically stacked courses 10-1, 10-2. It will be understood that the depiction of only two courses 10-1, 10-2 is for purposes of illustration and that an actual coke oven wall section being constructed/repaired will include any desired number of vertically stacked courses necessary to provide a complete wall structure.

Each of the courses 10-1, 10-2 includes opposed pairs of latitudinally separated vertically stacked side wall panels 12 and respective interior bridge components 14 transversely extending between such opposed pairs of side wall panels. A plurality of coke oven flue spaces 16 are therefore defined between adjacent ones of the longitudinally separated bridge components 14 and are latitudinally bounded by respective portions of the side wall panels 12. An end cap block 18 can be provided at the terminal end of each of the courses 10-1, 10-2.

As is perhaps best depicted in FIGS. 1A and 2-6, each of the side wall components 12 includes multiple sets of inwardly projecting integral finger forms 12*a*, 12*b* which collectively define a dovetail joint space 20 by opposed divergent side surfaces 20*a* and the rear surface 20*b*. The side wall panels 12 also define a tongue 23*a* and groove 23*b* extending longitudinally along the bottom and top edges, respectively, so as to cooperate with correspondingly configured grooves 23*b* and tongues 23*a* provided with vertically stacked adjacent panels 12. The opposite end edges of each panel 12 are also provided with mirror image exterior and interior L-shaped recesses 22*a*, 22*b* sized and configured to receive a corresponding interior and exterior L-shaped recess 22*b*, 22*a* associated with a longitudinally adjacent panel 12.

Each of the side wall components 12 is preferably a precast structure formed of a suitable refractory material (e.g., fused silica) that is mechanically pressed and cured at high temperatures (e.g., up to about 1400° C.) as described, for example, in U.S. Pat. Nos. 2,599,236, 2,802,749 and 2,872,328, the entire contents of each such patent being expressly incorporated hereinto by reference. The side wall components may also be formed by casting and heat curing a refractory material (e.g., fused silica) as described in U.S. Pat. Nos. 5,277,106 and 5,423,152, the entire contents of each such patent being expressly incorporated hereinto by reference.

The bridge components 14 may be precast of the materials described above or formed using a castable refractory material which can be cast in situ in the manner described below. Any castable refractory material may be employed for such purpose. One exemplary castable refractory material are the FosKast™ FSP family of castable refractory materials commercially available from Fosbel, Inc. of Brook Park, Ohio.

Figure 2:
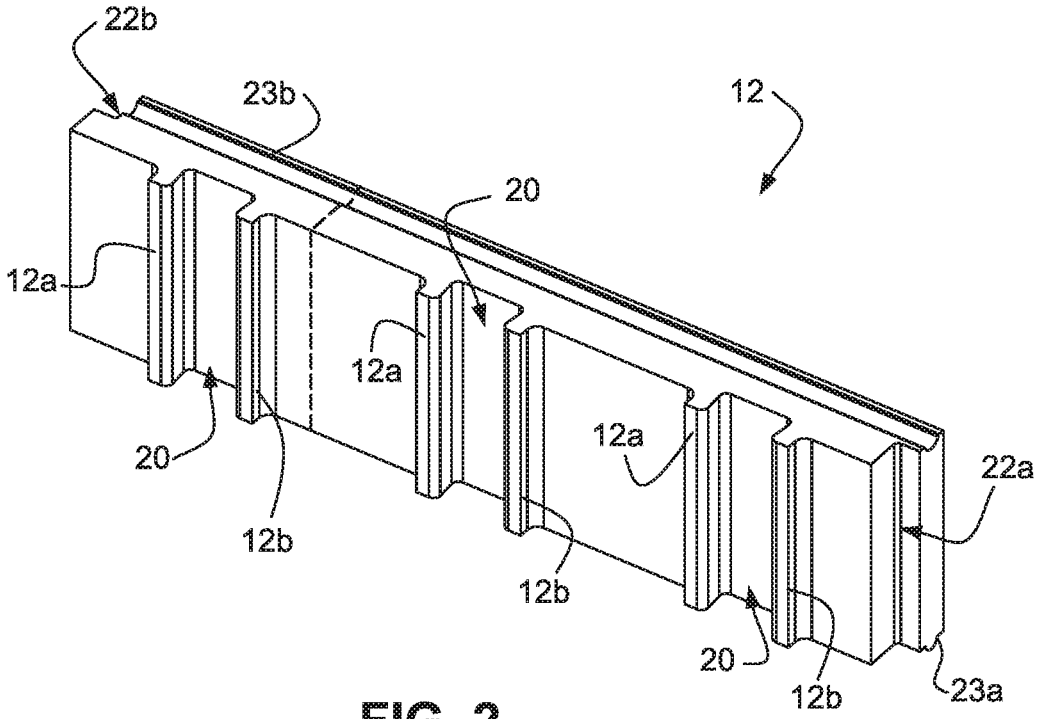
FIG. 2 is an interior side perspective view of an exemplary precast refractory side wall panel employed in the coke oven wall section of FIG. 1.
Figure 3:
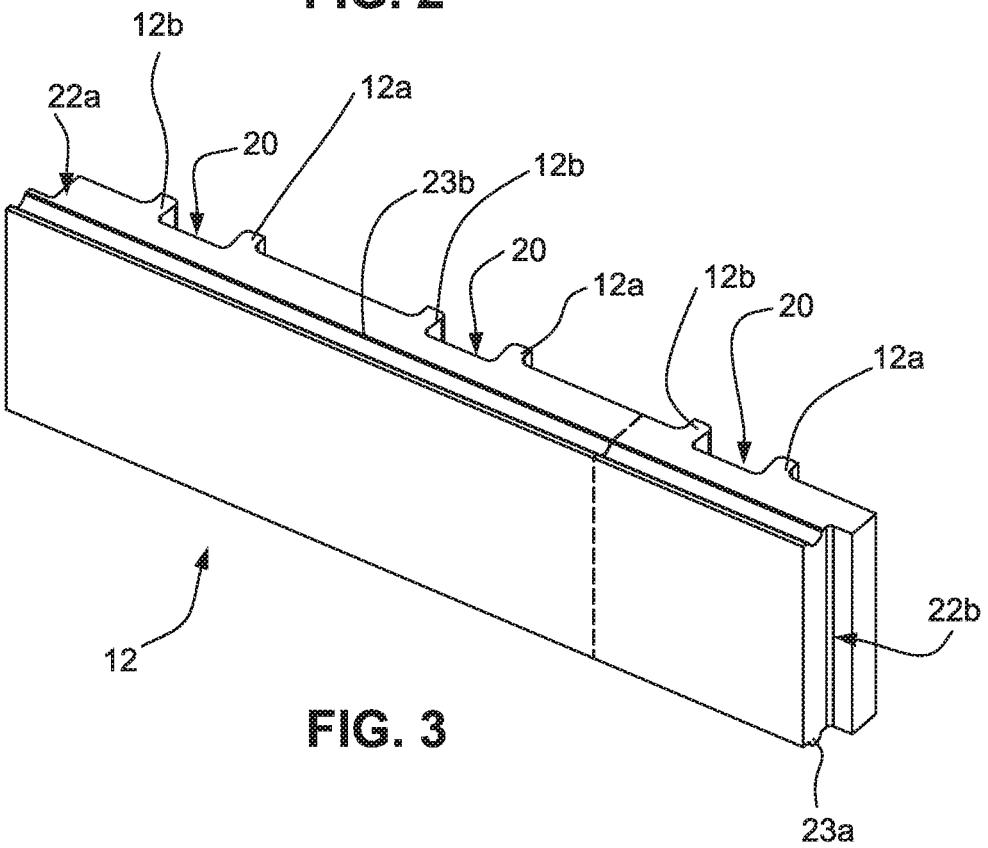
FIG. 3 is an exterior side perspective view of the side wall panel shown in FIG. 2.
Figure 4:
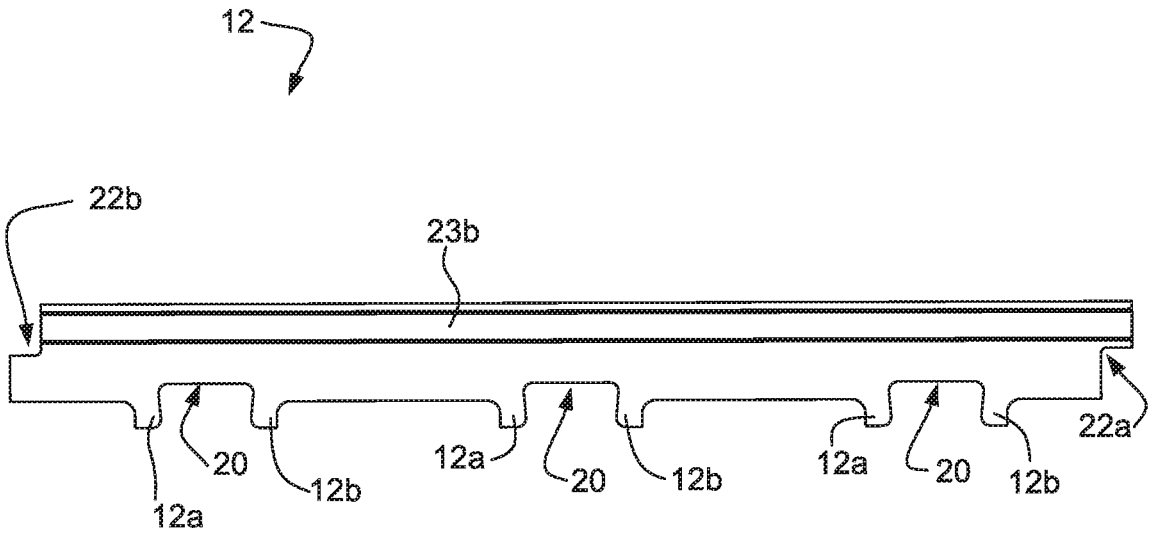
FIG. 4 is a top plan view of the sidewall panel shown in FIG. 2, the bottom plan view being a mirror image thereof.
Figure 5:
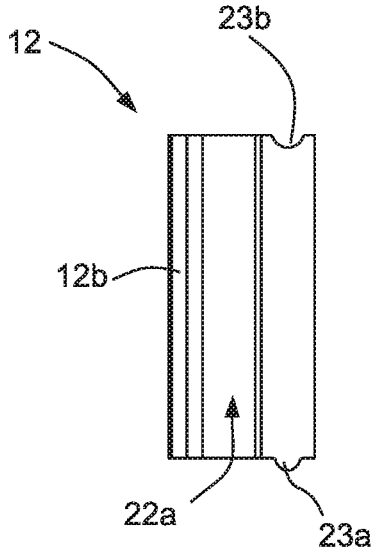
FIGS. 5 and 6 are left and right end elevation views of the side wall panel shown in FIG. 2.
Figure 6:
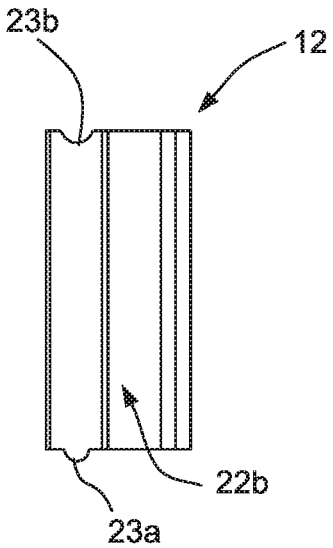

In order to ensure a staggered relationship between vertically adjacent stacked side wall components 12, one or more of the side wall components 12 can be shortened (e.g., by cutting) about one-third of the lengthwise extent of a larger (standard) side wall component 12 (e.g., as shown by the dashed lines in FIGS. 2 and 3). The cut section of the wall component 12 could then be used again in a further course to ensure that the abutted end seams of the side wall components 12 do not align with the abutted end seams of side wall components 12 in vertically adjacent courses.

Figure 7:
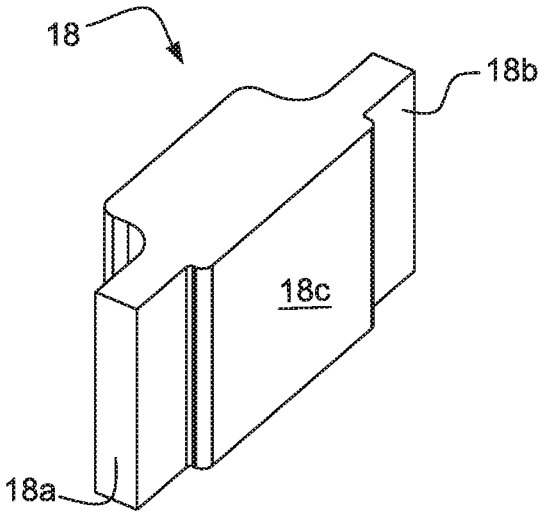
FIG. 7 is a perspective view of an exemplary end cap component employed in the coke oven wall section of FIG. 1.

As shown in FIG. 7, the end cap block 18 is formed as a generally T-shaped block of precast refractory materials and serves to close a terminal end of each of the courses 10-1, 10-2. In this regard, the end cap block 18 includes laterally extending side members 18*a*, 18*b* that are sized and configured to extent laterally to the exterior surfaces of the side panels 12. An interior boss 18*c* is provided so as to extend between the interior surfaces of the panels 12. A refractory adhesive grout or binder may be used in order to secure the end cap blocks 18 to the end edges of the panels 12. In those instances where the end cap block 18 forms a side surface of the castable bridge component 14, the binding properties of the castable refractory material will serve to positionally secure the end cap block 18.

Figure 8:
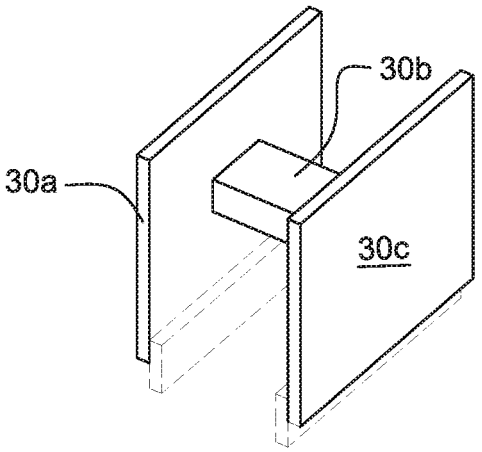
FIG. 8 is a perspective view of an exemplary removable form that may be employed during the construction of the coke oven wall section.

An exemplary removable form 30 that may be employed during casting of the bridge components 14 is shown in FIG. 8. The form 30 may be constructed of any suitable rigid material (e.g., metal, plastic or wood) that can be used to contain the castable refractory material forming the bridge components 14. As shown in FIG. 8, the removable form 30 includes opposed face panels 30*a* which are separated from one another by a rigid cross-support 30*b*. The dimension of the cross-support 30*b* is such that the exterior surfaces of the face panels 30*a* will abut against corresponding exterior surfaces of the integral finger forms 12*a*, 12*b*. For all subsequent vertically stacked course other than the first (ground level) course, the face panels 30*a* may be provided with an inwardly recessed L-shaped bottom flange 30*d*.

Figure 9:
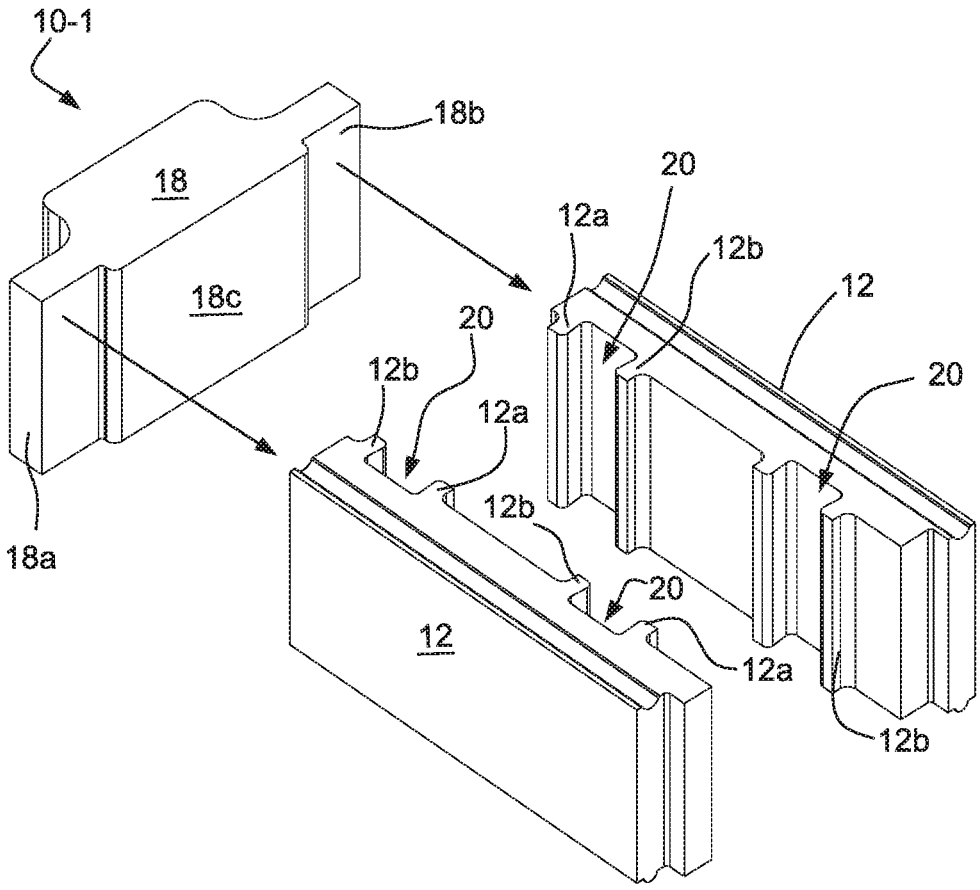
FIGS. 9-16 show a sequence of steps that may be employed to construct a first course of the coke oven wall section depicted in FIG. 1.

A method by which an initial and subsequent courses of the coke oven wall 10 may be constructed is schematically depicted in FIGS. 9-16. Specifically, as shown in FIG. 9, a pair of side panels 12 may be separated from one another by a predetermined distance to establish the widthwise dimension of the resulting coke oven wall 10. An end cap block 18 may then be positioned so as to close the terminal end space between the side panels 12. It will be observed from FIG. 9 that sets of integral finger forms 12*a*, 12*b* of one panel 12 are directly opposite to respective sets of the integral finger forms 12*a*, 12*b* of the other panel 12 such that a pair of the joint spaces 20 are directly opposed to one another in the widthwise direction of the wall 10.

Figure 10:
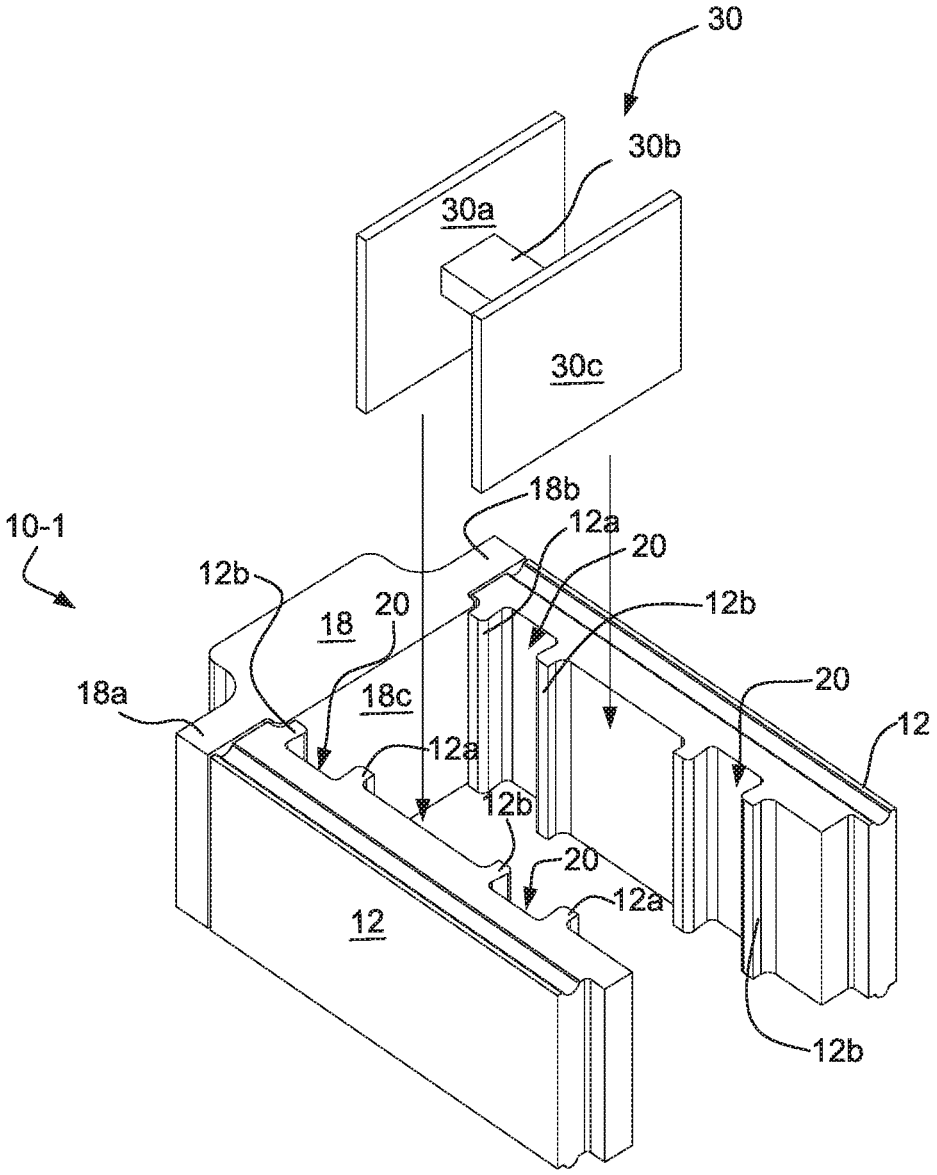
Figure 11:
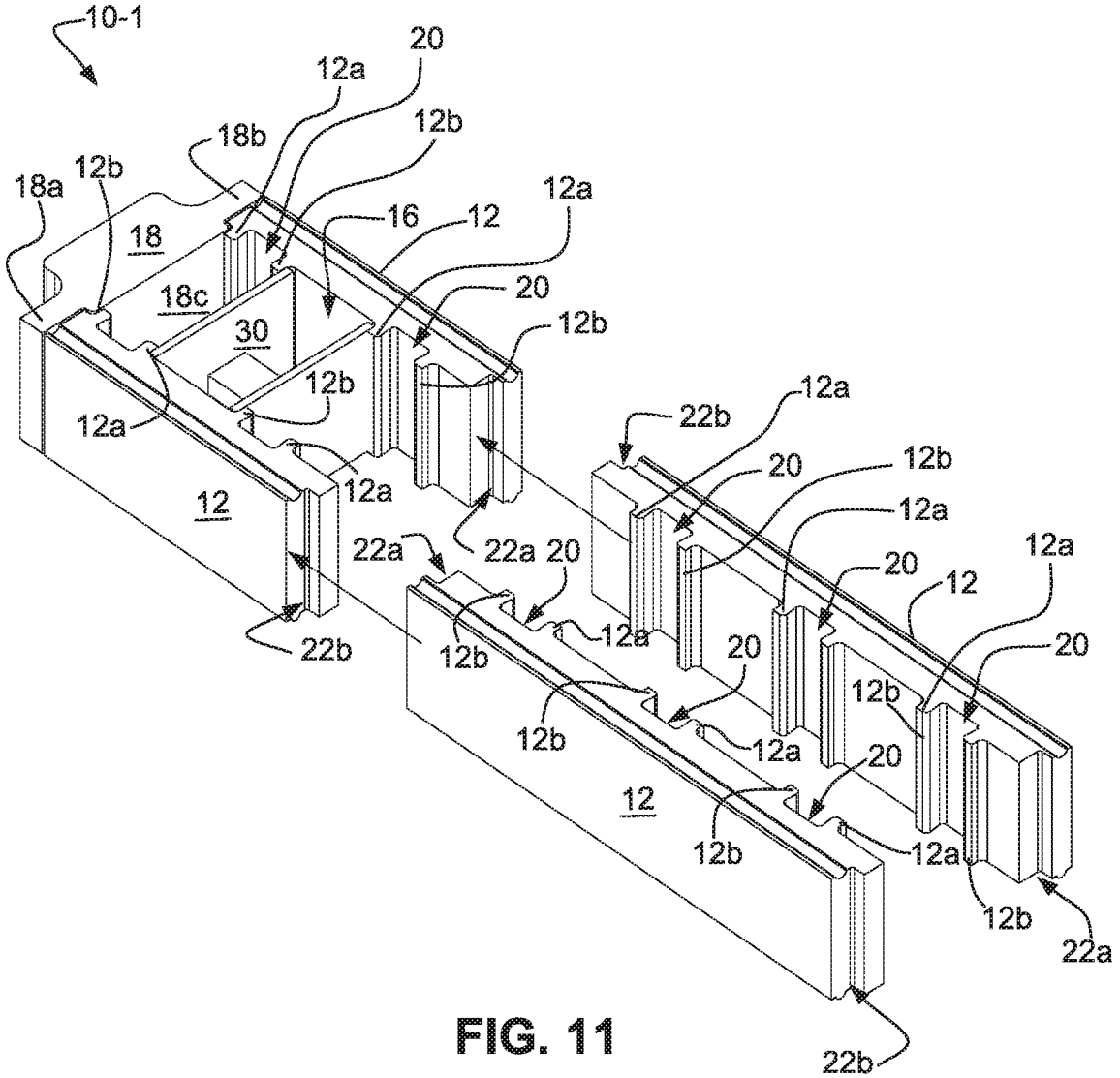

As shown in FIG. 10 once the opposed panels 12 are positioned as desired, at least one of the forms 30 may be inserted between adjacent sets of finger forms 12*a*, 12*b* into what will ultimately become the coke oven wall flue spaces 16. Thereafter, as shown in FIG. 11, additional panels 12 may be positioned in end-to-end relationship with the previously installed panels 12 (i.e., by mating the L-shaped exterior recess 22*a* of the former with the correspondingly configured L-shaped interior recess 22*b* of the latter).

Figure 12:
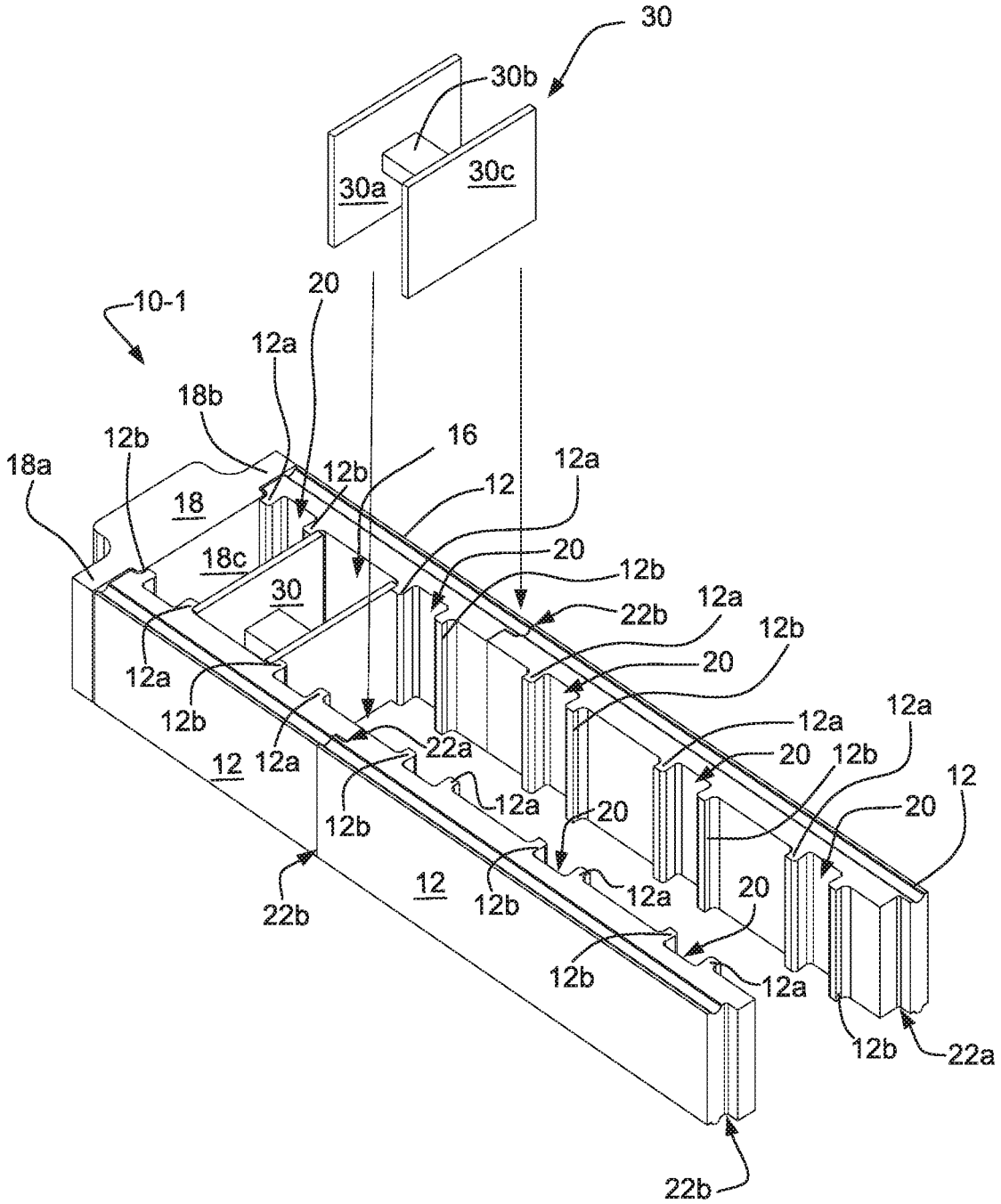
Figure 13:
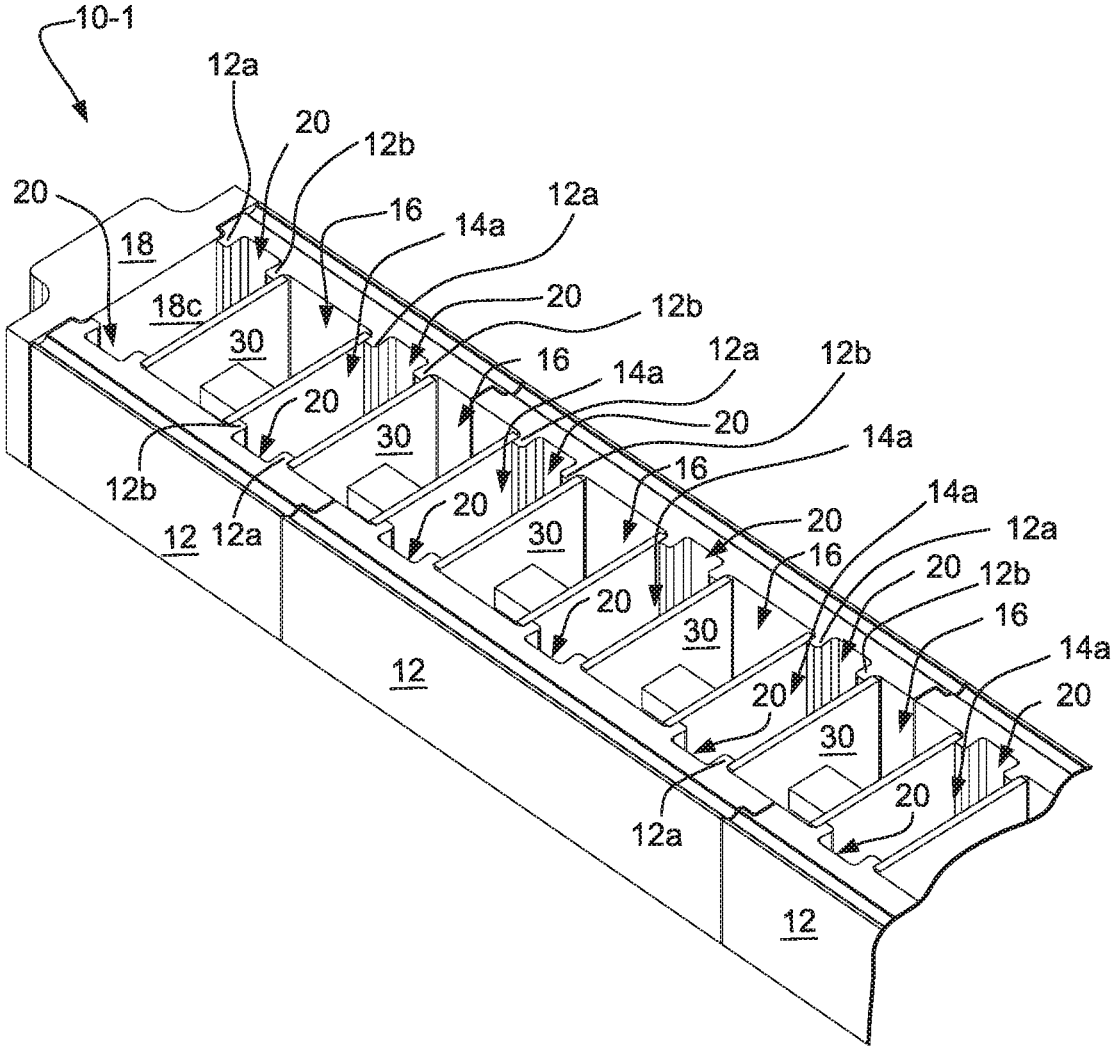

Once additional panels 12 are installed in an end-to-end manner with the previously installed panels 12, additional removable forms 30 may be inserted between adjacent sets of finger forms 12*a*, 12*b* into what will ultimately become the coke oven wall flue spaces 16 as describe previously. Such a state is shown in FIG. 12. Ultimately all removable forms 30 will be installed so as to obtain a course (in this case course 10-1) with all removable forms 30 positioned between respective adjacent sets of finger forms 12*a*, 12*b*. Such a state is depicted in FIG. 13. It will be understood that such procedures may be repeated as many times as may be required to achieve the desired lengthwise extent of the course 10-1 for the coke oven wall 10 under construction/repair.

Figure 14:
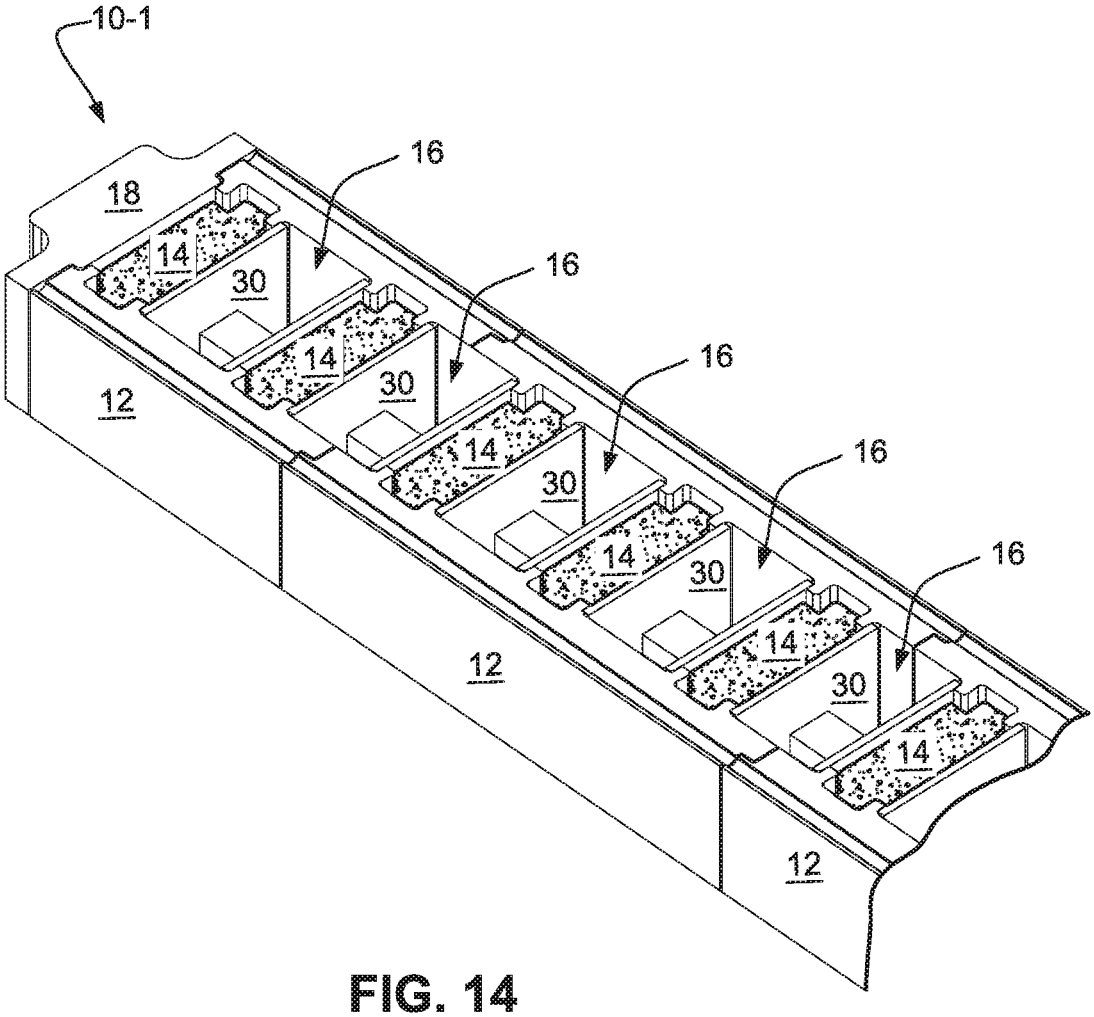

When the side panels 12 and removable forms 30 have been installed for a complete course (e.g., course 10-1 as shown), the bridge space 14*a* between adjacent ones of the forms 30, including the dovetail joint space 20 of the finger forms 12*a*, 12*b* may be filled with a castable refractory material to thereby provide the bridge components 14 when cured. The state in which the castable refractory material has been poured but not yet cured is depicted in FIG. 14.

In the embodiment depicted, it will be observed that the bridge space 14*a* between adjacent removable forms 30 is not filled completely with castable material so as to be flush with the upper edges of the panels 12, but instead is filled such that a top surface of the castable material is at a lower elevation as compared to the elevation of the top surface of the panels 12 so as to define a relatively small (e.g., about an inch+/−) but meaningful vertical gap G (see FIG. 1A) between the top surface of the castable material forming the bridge component 14 and the top surface of the panels 12. Therefore, when additional castable material is poured into a corresponding bridge space 14*a* between adjacent removable forms 30 for the vertically adjacent course 10-2, the gap G will then be filled with a portion of such castable material and thereby assist with longitudinal sealing of the flue spaces 16 against gas leakage.

Figure 15:
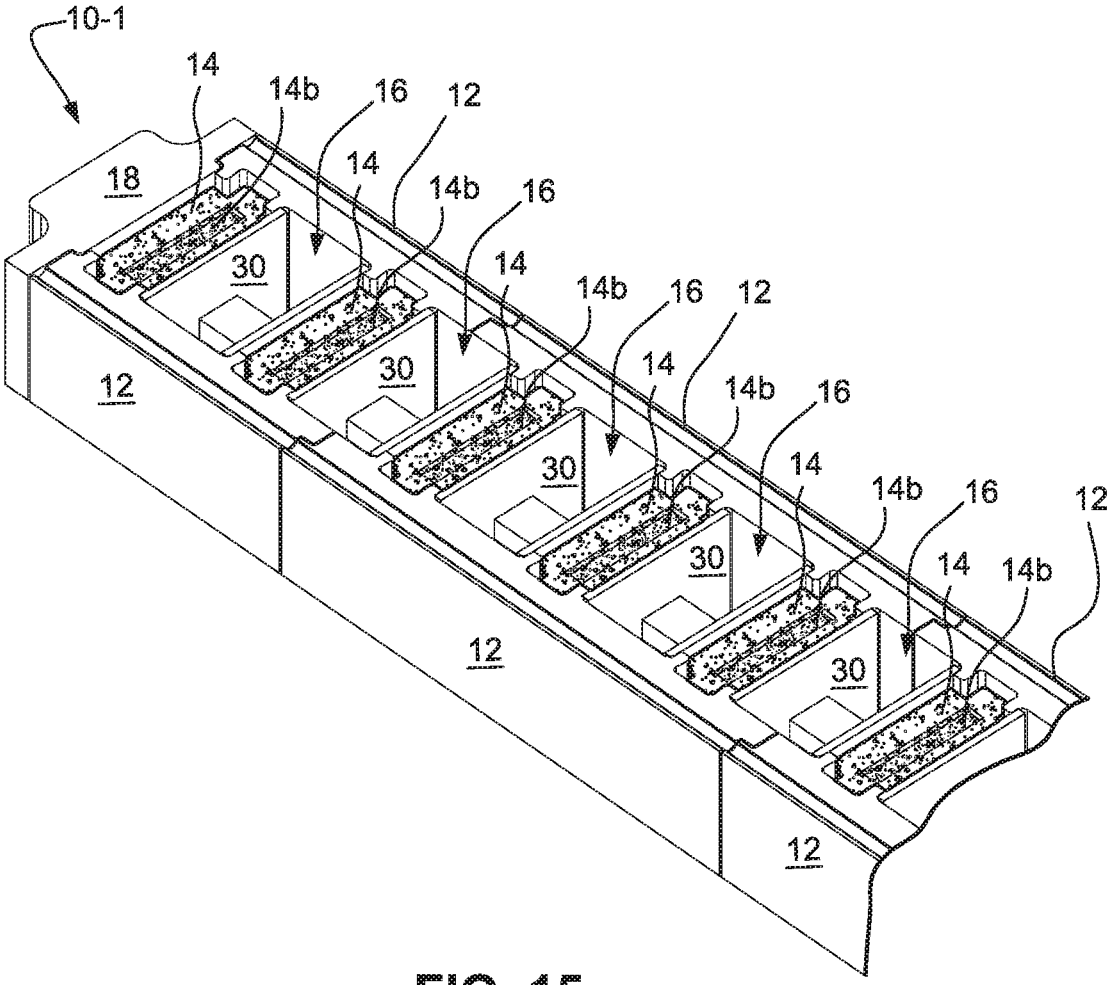

To further assist in such gas sealing of the flue spaces 16, the top surface of the castable material forming the bridge component 16 may be scored prior to curing with a suitably shaped bar (e.g., by forcibly pressing the bar into the uncured castable material) so as to form top surface grooves 14*b* therein. Such a state is shown in FIG. 15. Thus, when additional castable material is poured to form vertically adjacent ones of the bridge components 14 during construction of the course 10-2 on top of the already cured material forming the bridge components 14 in course 10-1, some of such additional castable material will enter the groove 14*b* and thereby form a correspondingly configured tongue (not shown) which assists with the sealing of the flue spaces 16.

Figure 16:
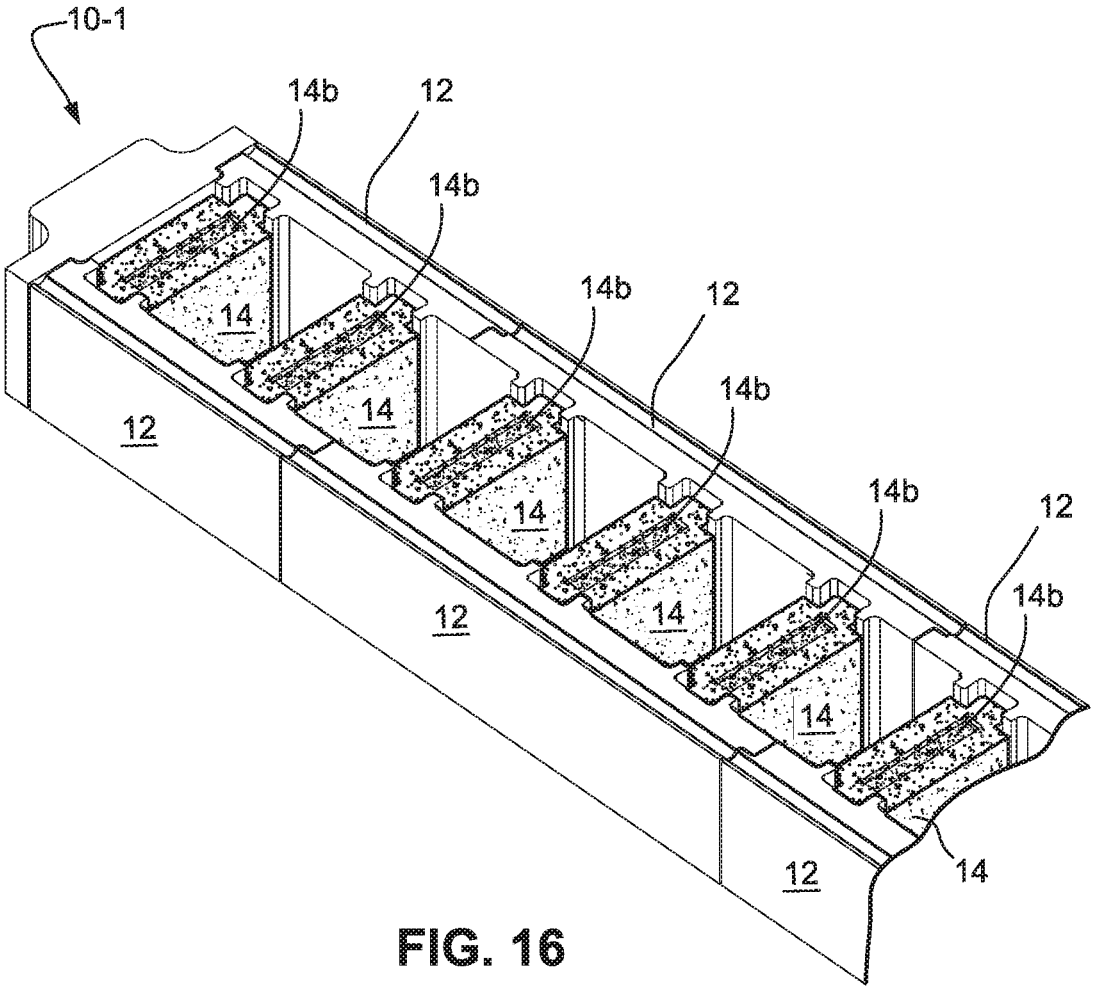
Figure 17:
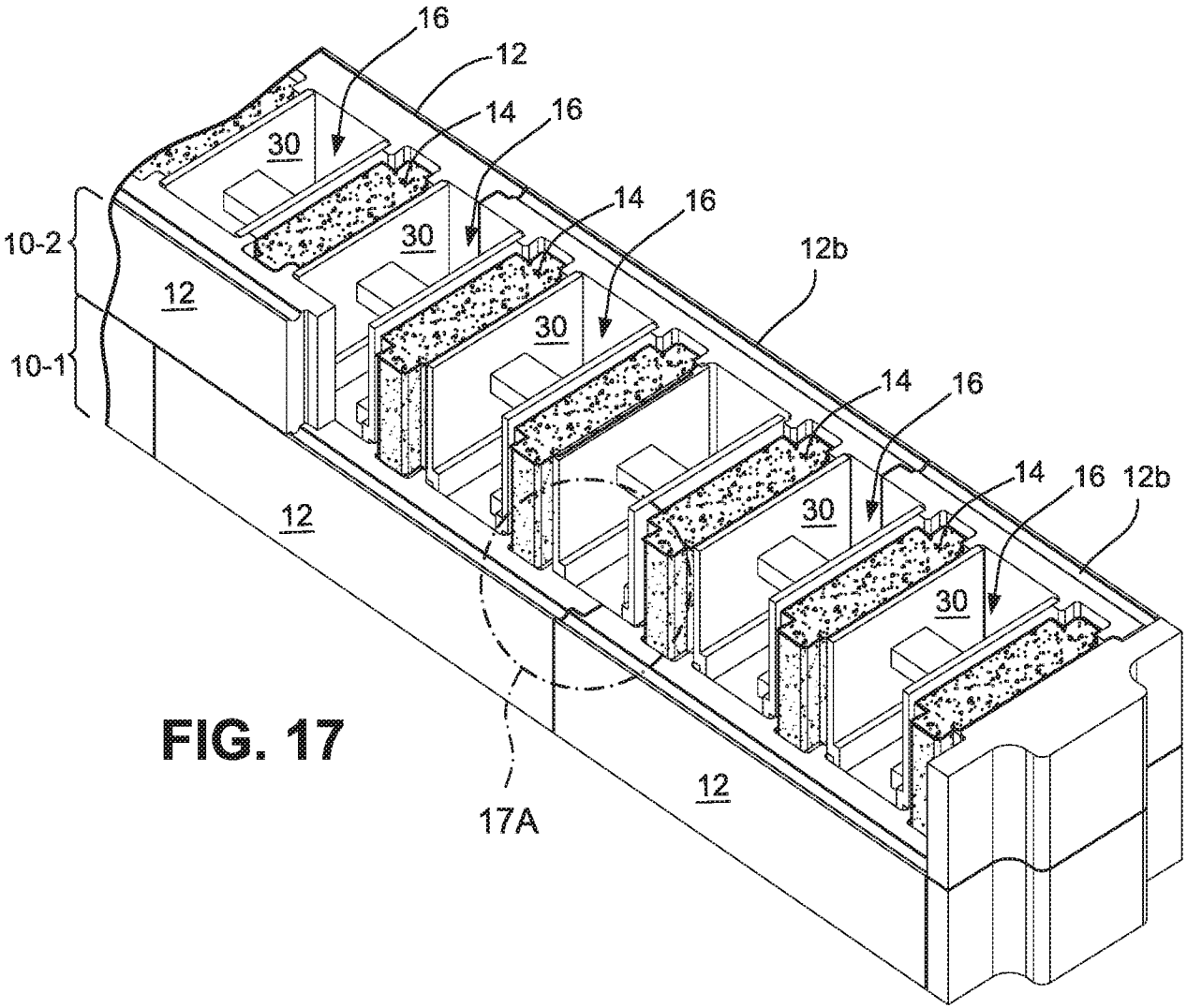
FIG. 17 is a perspective view of the construction of a second course of the coke oven wall section.
Figure 17A:
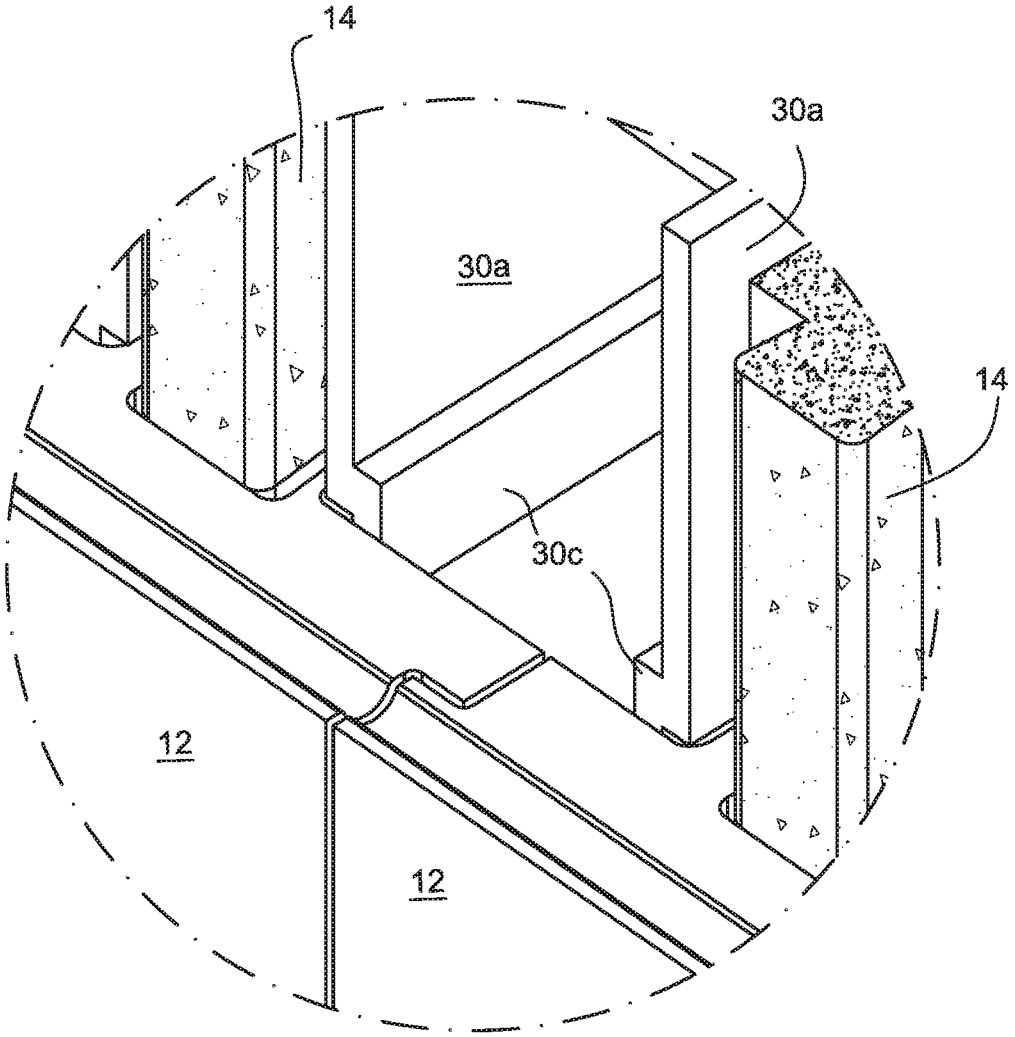
FIG. 17A is an enlarged detail view of the second course of the wall showing certain side wall panels removed so as to reveal the structural cooperation between the removable forms in the second course and the integral finger forms of the side wall components.

When the castable material is cured sufficient to form the rigid bridge components 14, the removable forms 30 may be removed physically thereby providing the first course 10-1 as shown in FIG. 16. Thereafter, as shown in FIG. 17, the construction techniques described above may be repeated for the next vertically adjacent course 10-2 (as well an any further vertically adjacent courses that may be needed) in order to form the coke oven wall 10 as depicted in FIG. 1. As will be noted in FIG. 17A, when constructing a vertically adjacent course, the removable forms 30 will preferably include L-shaped flanges 30*c* so as to assist in the positioning of the forms 30 onto the bridge components 14 of a subjacent course.

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. A method of constructing a refractory wall structure having gas flue spaces comprising the steps of:

(a) forming a first course of the refractory wall structure by installing opposing refractory side wall panels that are separated by a distance which defines a widthwise dimension of the wall structure and an interior wall space therebetween, wherein each of the side wall panels includes multiple sets of spaced-apart finger forms such that each set of the finger forms define a respective joint space therebetween, wherein the sets of finger forms protrude inwardly into the interior wall space such that each set of the finger forms of one side panel are oppositely positioned relative to a respective set of the finger forms of an opposed side wall panel;

(b) providing a series of H-shaped removable forms, wherein each H-shaped removable form includes a pair of face panels and a cross-support extending between the face panels;

(c) positioning the H-shaped removable forms between longitudinally adjacent ones of the multiple sets of finger forms such that each face panel of the H-shaped removable form is positioned against respective oppositely positioned ones of the finger forms to thereby establish a bridge space between opposed face panels of the removable forms which includes the joint space defined between the sets of finger forms;

(d) pouring a castable refractory material into the bridge space;

(e) allowing the castable refractory material to cure in the bridge space to form rigid refractory bridge components which extend the widthwise dimension of the wall and include portions filling the joint spaces of the sets of finger forms; and (f) removing the removable forms to thereby establish respective gas flue spaces between adjacent ones of the bridge components.

2. The method according to claim 1, further comprising forming a second course vertically adjacent to the first course by stacking additional side wall panels of the second course on the side wall panels of the first course and then repeating steps (b)-(f) to thereby form the second course with the first course being subjacent to the second course.

3. The method according to claim 1, wherein step (d) comprises pouring the castable refractory material into the bridge space such that a top surface of the castable refractory material in the bridge space is positioned at a lower elevation as compared to an elevation of top surface of the side wall panels thereby forming a vertical gap therebetween.

4. The method according to claim 3, wherein the method further comprises between steps (d) and (e) a step of forming a groove in the top surface of the castable refractory material.

5. The method according to claim 1, wherein step (a) comprises installing an end cap block at a terminal end of the first course.

6. The method according to claim 1, wherein the joint space defined by the multiple sets of finger forms is a dovetail joint space.

7. The method according to claim 6, wherein the bridge component includes portions which fill the dovetail joint spaces so that the bridge components are interlocked with the finger forms and the side wall panels.

8. The method according to claim 2, wherein the side wall panels comprise a groove on a top edge surface thereof, and a tongue on a bottom edge surface thereof, and wherein the method comprises positioning the additional sidewall panels of the second course in stacked vertical relationship to the sidewall panels of the first course which is subjacent to the second course such that the tongue of the additional sidewall panels of the second course is received within the groove of the sidewall panels of the first course.

9. The method according to claim 8, wherein the bridge components of the second course are formed by pouring additional castable material in the bridge spaces of the second course.

10. The method according to claim 2, wherein step (b) comprises providing removable forms of the second course which further comprise L-shaped flanges at a bottom edge of the face panels, and wherein step (c) comprises positioning the L-shaped flanges on respective vertically subjacent bridge components of the first course.

* * * * *